US008485833B2

(12) United States Patent
Kataoka et al.

(10) Patent No.: US 8,485,833 B2
(45) Date of Patent: Jul. 16, 2013

(54) CONNECTOR AND TERMINAL ARRANGEMENT MEMBER

(75) Inventors: Shigeto Kataoka, Yokkaichi (JP); Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/313,420

(22) Filed: Dec. 7, 2011

(65) Prior Publication Data

US 2012/0190242 A1 Jul. 26, 2012

(30) Foreign Application Priority Data

Jan. 21, 2011 (JP) ..... 2011-010650

(51) Int. Cl.
*H01R 12/00* (2006.01)

(52) U.S. Cl.
USPC ..... 439/79; 439/84

(58) Field of Classification Search
USPC ..... 439/79, 541.5, 84, 572
See application file for complete search history.

(56) References Cited

U.S. PATENT DOCUMENTS

| | | | | |
|---|---|---|---|---|
| 5,522,730 | A * | 6/1996 | Soes et al. | 439/78 |
| 5,931,686 | A * | 8/1999 | Sasaki et al. | 439/78 |
| 6,334,783 | B1 * | 1/2002 | Hu | 439/84 |
| 6,494,724 | B1 * | 12/2002 | Bixler et al. | 439/79 |
| 2009/0035966 | A1 * | 2/2009 | Yuan et al. | 439/83 |

FOREIGN PATENT DOCUMENTS

| | | |
|---|---|---|
| JP | 2006-245535 | 9/2006 |

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A substrate connection part (4) of each of a plurality of press-fit terminals (3) pulled out of a housing (1) is inserted into a positioning hole (12) of a terminal arrangement member (11) to adjust alignment of the press-fit terminals (3) with respect to through-holes (7) of a substrate (6). The terminal arrangement member (11) is made of a thin resin sheet material. Each positioning hole (12) is sized so that the press-fit terminal (3) is placed in position by inserting a guide portion (9) of the press-fit terminal (3) therein. Slits (13) extend radially out from an opening edge of the positioning hole (12). When a press-fit portion (8) passes through the positioning hole (12), both slits (13) and the positioning hole (12) expand so that the press-fit portion (8) passes smoothly through the positioning hole (12).

10 Claims, 11 Drawing Sheets

CONNECTOR AND TERMINAL ARRANGEMENT MEMBER

BACKGROUND OF THE INVENTION

1. Field of the Invention

The invention relates to a connector and a terminal arrangement member.

2. Description of the Related Art

Japanese Patent Unexamined Publication No. 2005-294210 discloses a connector that uses a press-fit terminal in connection with a substrate. The press-fit terminal has a substrate connection part and a press-fit portion bulges from the substrate connection part. The press-fit portions can be press-fit into the through-holes of the substrate to connect the connector electrically to the substrate without soldering. In this conventional art, a terminal arrangement member is mounted on the substrate connection part of each press-fit terminal for adjusting the alignment of the press-fit terminals. Positioning holes are formed through the terminal arrangement member in correspondence to the press-fit terminals. A front end of each press-fit terminal is inserted into the corresponding positioning hole to place the press-fit terminals in position.

The press-fit portion must pass through the positioning hole and expand the positioning hole before the press-fit portion of each press-fit terminal is inserted into the corresponding through-hole of the substrate. However, the terminal arrangement member is a flat synthetic resin plate having a thickness of about 1mm and generates a high resistance in the operation of expanding the positioning hole. Thus, the press-fit terminal is liable to be deformed.

A terminal arrangement member of a thin resin sheet would exert less resistance on the press-fit terminal. However, there is a fear that the peripheral portion of the positioning hole will be brought into the through-hole when the press-fit portion passes through the positioning hole. As a result, the terminal arrangement member could be interposed between a conductive portion of the through-hole and the press-fit portion, with an adverse effect on the electrical conductivity between the terminal and the substrate.

The invention has been completed in view of the above-described situation and an object of the invention to provide a connector and a terminal arrangement member that allow a press-fit terminal to be mounted on a substrate while an operation of placing the press-fit terminal in position is being performed.

SUMMARY OF THE INVENTION

The invention provides a connector with a housing mountable on a substrate formed with through-holes. Press-fit terminals are accommodated in the housing. Each press-fit terminal has opposite front and rear ends. A terminal connection part is formed at the rear end and is connectable with a mating terminal fitting. A press-fit portion bulges near the front end of the press-fit terminal and can be inserted into the through-hole by press fit. The connector also has a terminal arrangement member with positioning holes for receiving a portion of each of the press-fit terminals forward from the press-fit portion before the press-fit portion of each of the press-fit terminals is inserted into the through-hole. Thus, the terminal arrangement member allows the press-fit portions of the press-fit terminals to be placed collectively in position. A gap-forming part is formed radially outward from positions of an opening edge of each of the positioning holes, which are opposed to side edges of the press-fit portion. The gap-forming part can expand each positioning hole with a passage of the press-fit portion through the positioning hole.

The portion of the press-fit terminal forward from the press-fit portion is in the positioning hole before the press-fit portion of each of the press-fit terminals is press fit into the corresponding through-hole of the substrate. Thus the portion of the press-fit terminal forward from the press-fit portion is held in position. In this state, the press-fit portion is passed through the positioning hole to insert the press-fit portion into the through-hole of the substrate. At this time, the side edges of the press-fit portion are at the gap-forming part of the positioning hole. The gap-forming part gradually expands the aperture width of the positioning hole radially out from the opening edge of the positioning hole with the passage of the press-fit portion through the positioning hole. Thus, the entire positioning hole is expanded easily and the work of mounting the press-fit terminal on the substrate is performed easily.

The terminal arrangement member is made of a thin resin sheet material. Therefore compared with a conventional art in which the terminal arrangement member is made of a flat resin plate, the gap-forming part is capable of easily expanding the positioning hole and in addition, a portion of the terminal arrangement member is not forced into the through-hole. Thus, the terminal arrangement member ensures the preferred electrical conductive state for the substrate.

The gap-forming part comprises slits formed radially outward from positions of the opening edge of the positioning hole, which are opposed to both side edges of the press-fit portion.

The gap-forming part may comprises a thin groove extended radially out from positions of the opening edge of the positioning hole that are opposed to side edges of the press-fit portion. Therefore the gap-forming part is capable of performing the operation of expanding the positioning hole more smoothly.

The gap-forming part may comprise a perforation consisting of a plurality of through-holes formed radially outward side by side at predetermined intervals from positions, of the opening edge of the positioning hole, which are opposed to both side edges of the press-fit portion. Thus, the gap-forming part is not formed by cutting the terminal arrangement member and the positioning hole is not expanded inadvertently. Therefore the press-fit terminal can be placed accurately in position.

The invention also relates to a terminal arrangement member for positioning press-fit terminals of press-fit terminals projected from an outer surface of a connector housing before the press-fit portions are press fit into through-holes that penetrate through a substrate. The terminal arrangement member is disposed forward from a press-fit portion that bulges at a front end of each of the press-fit terminals. A gap-forming part is formed near an opening edge of a positioning hole that is opposed to side edges of the press-fit portion. The gap-forming part can form a slit extending radially out from an opening edge of a positioning hole when the press-fit portion passes through the positioning hole.

DETAILED DESCRIPTION OF THE PREFERRED EMBODIMENTS

Figure 1:
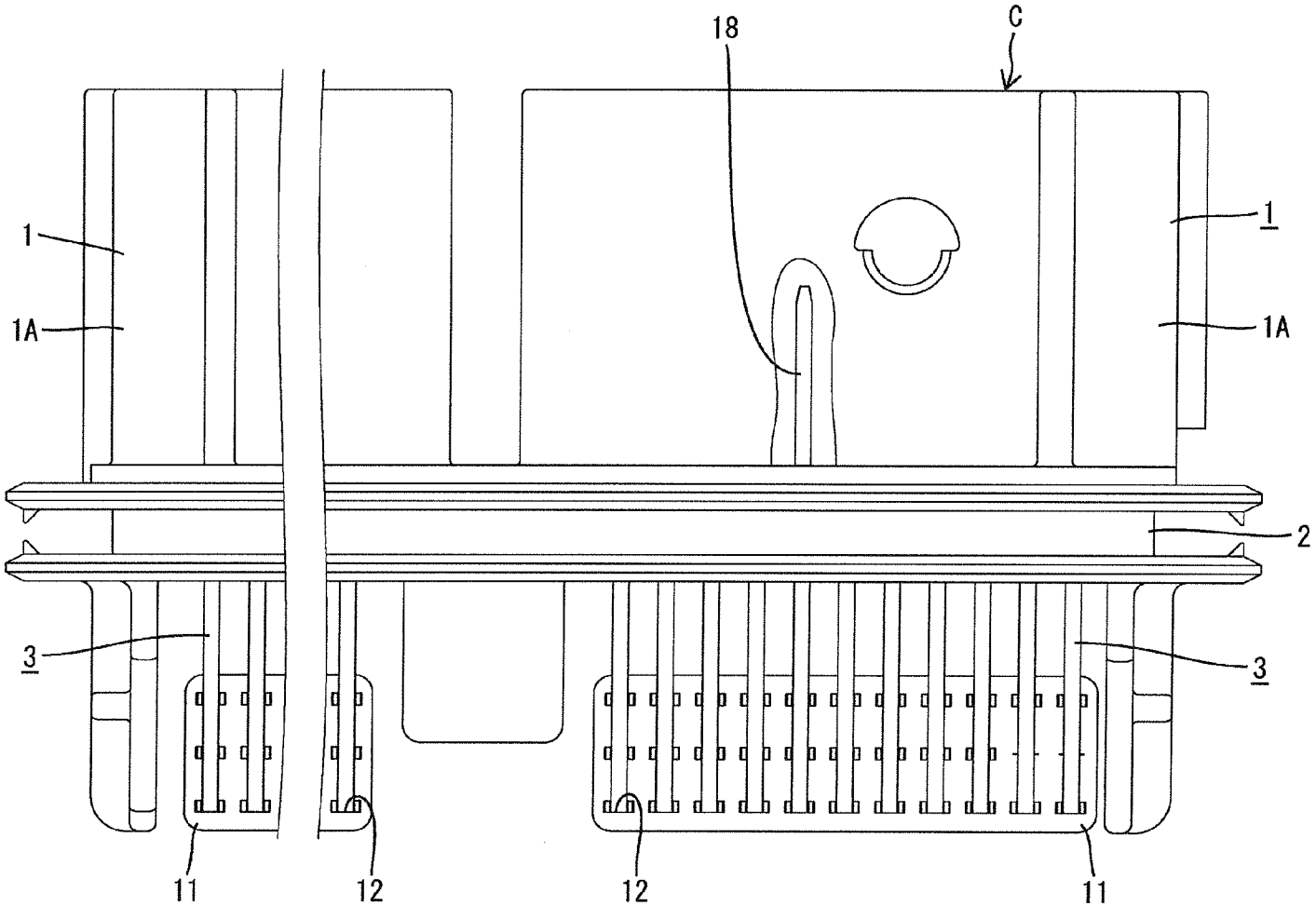
FIG. 1 is a plan view showing a connector in accordance with the invention.
Figure 2:
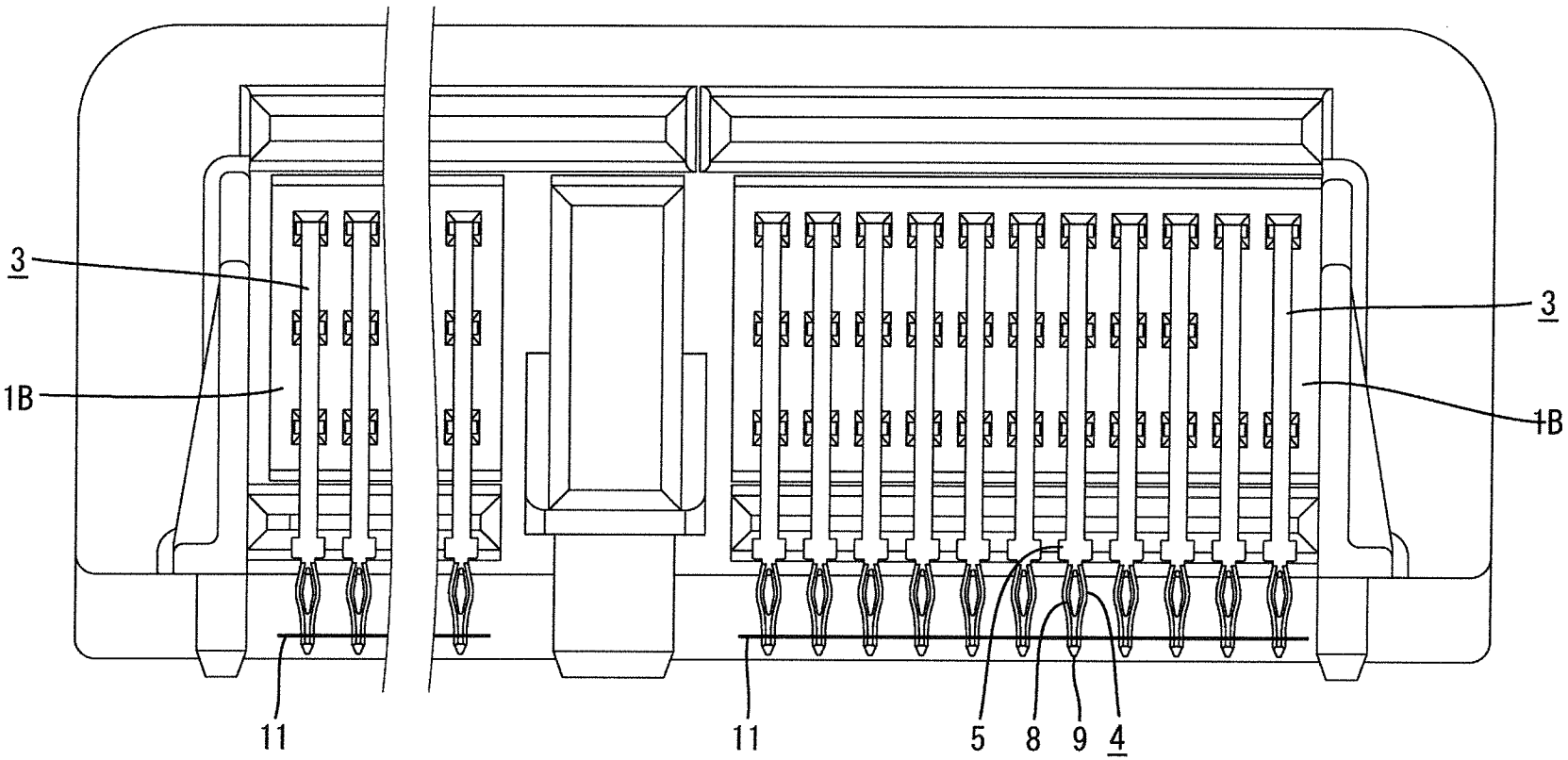
FIG. 2 is a rear view showing the connector shown in FIG. 1.
Figure 3:
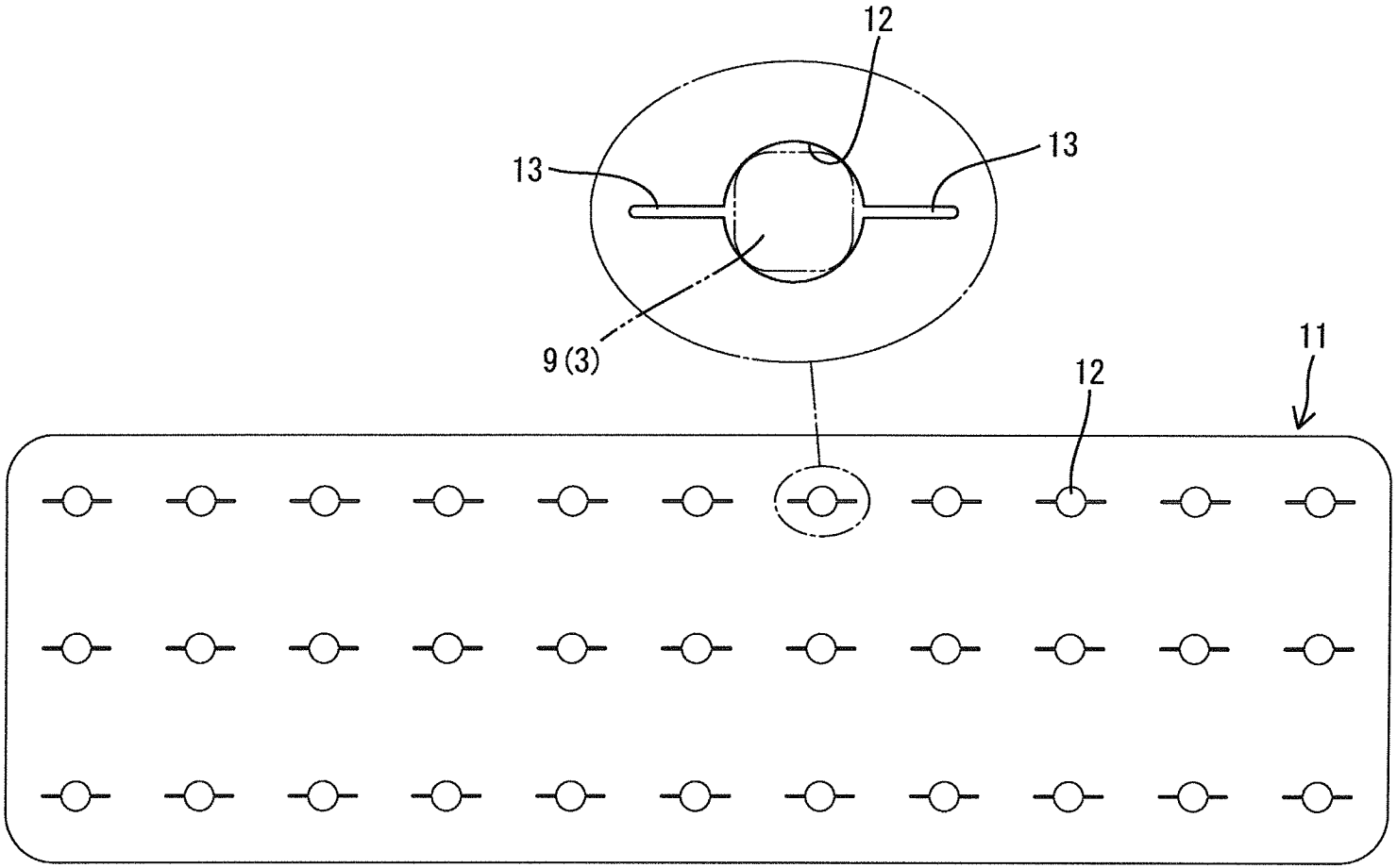
FIG. 3 is a plan view showing a terminal arrangement member.

A connector C for a printed-circuit board shown in FIG. 1 has two housings 1, having different sizes, which are arranged side by side on a base 2 where the housings 1 are to be mounted. Each housing 1 has a forwardly open quadrangular prism-shaped hood 1A that can be fit on a female housing. Each housing 1 also has press-fit terminals 3 mounted therein.

Each of the press-fit terminals 3 is made of a square pin-shaped conductive metal material. The press-fit terminals 3 are arranged side by side and are press fit through a rear wall 1B of the housing 1 from a rear end thereof. As a result, a terminal connection part 18 at one end of each of the press-fit terminals 3 projects inside the hood 1A. The press-fit terminals 3 and the female terminal fittings can be connected electrically to each other at the terminal connection part 18 when female and male connector housings fit on each other.

Each press-fit terminal 3 has a substrate connection end opposite the terminal connection part 18. Each substrate connection end projects horizontally rearward from the rear wall 1B of the housing 1 and then is bent down almost perpendicularly midway in the longitudinal direction thereof. The connector C has several of the press-fit terminals 3 arranged at predetermined intervals in each three steps in the height direction of the housing 1, as shown in FIG. 1. The press-fit terminals 3 of the three steps are arranged in the same phase in the width direction of the housing 1. The substrate connection end of each of the lowermost press-fit terminals 3 is bent down at positions nearest to the housing 1, whereas the substrate connection side of each uppermost press-fit terminal 3 is bent down at positions farthest from the housing 1.

A substrate connection part 4 is formed at the substrate connection end of each press-fit terminal 3. Two pressing shoulders 5 hang over the substrate connection part 4 and apply a pressing force to the substrate connection parts 4 by using a pressing jig when pressing the substrate connection parts 4 into through-holes 7 in a substrate 6. Although not shown in the drawings, an electrical conductive portion is formed on the wall of each through-hole 7.

Figure 4:
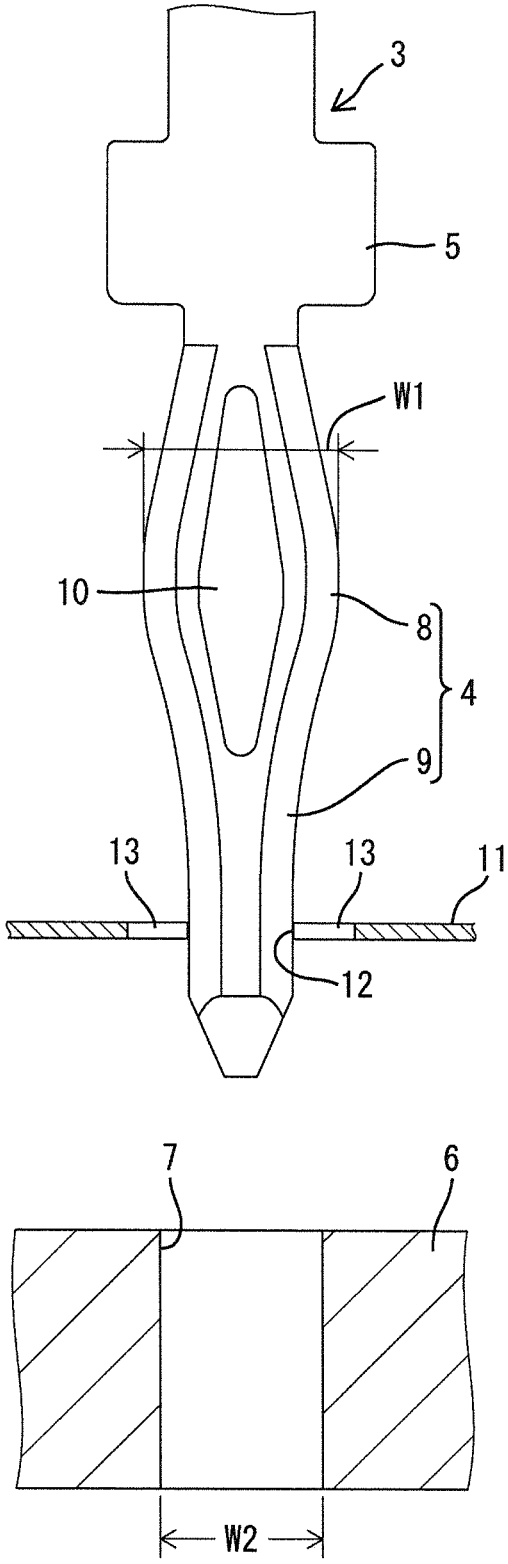
FIG. 4 is a sectional view showing a state in which a press-fit terminal is placed in position by means of a terminal arrangement member.
Figure 5:
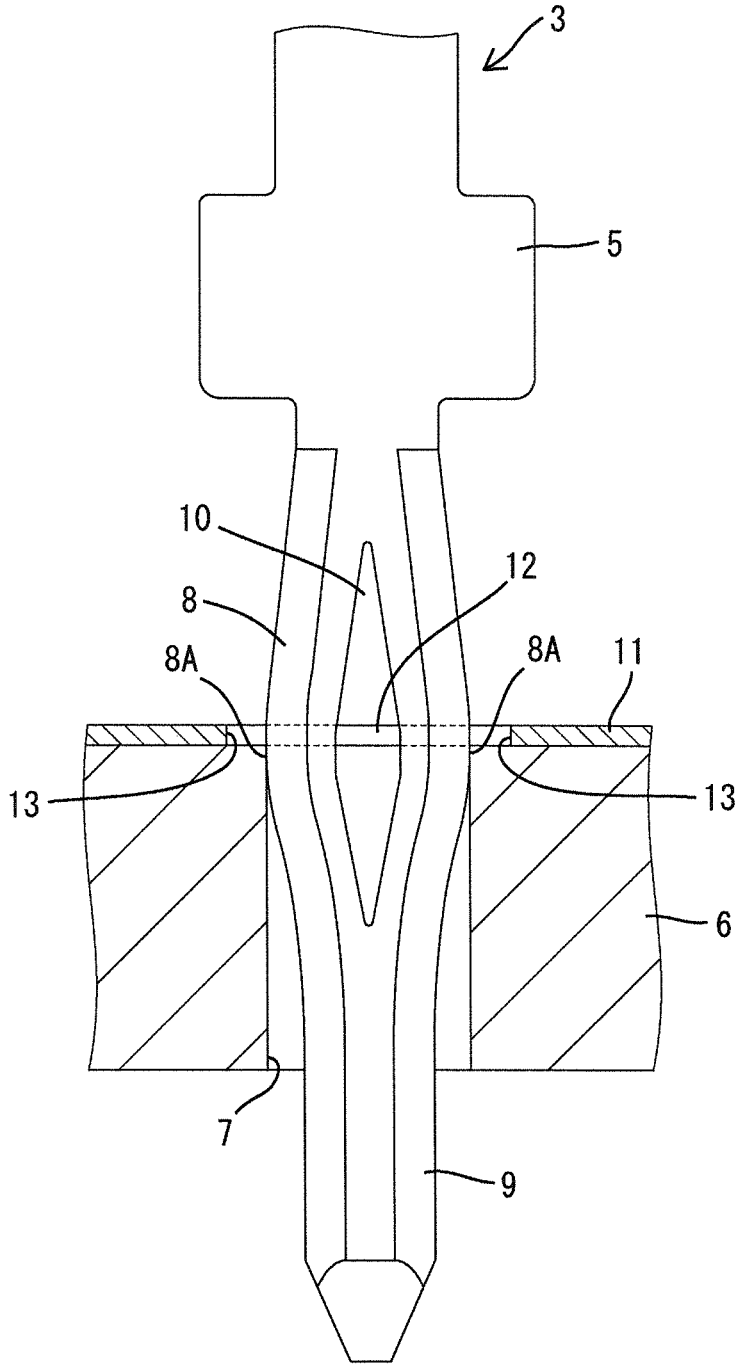
FIG. 5 is a sectional view showing a state in which the press-fit terminal is being inserted into a through-hole while a positioning hole is being expanded.
Figure 6:
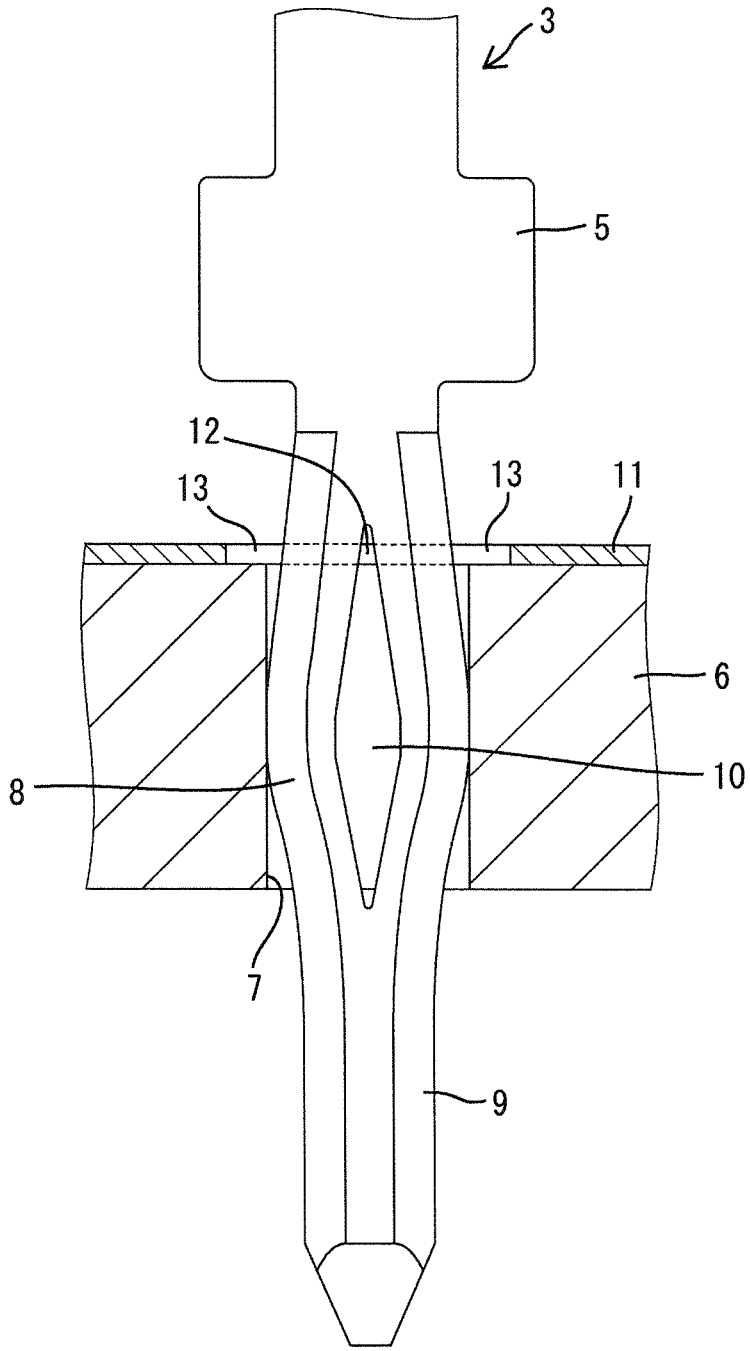
FIG. 6 is a sectional view showing a state in which the press-fit terminal has been normally mounted on the through-hole.
Figure 8:
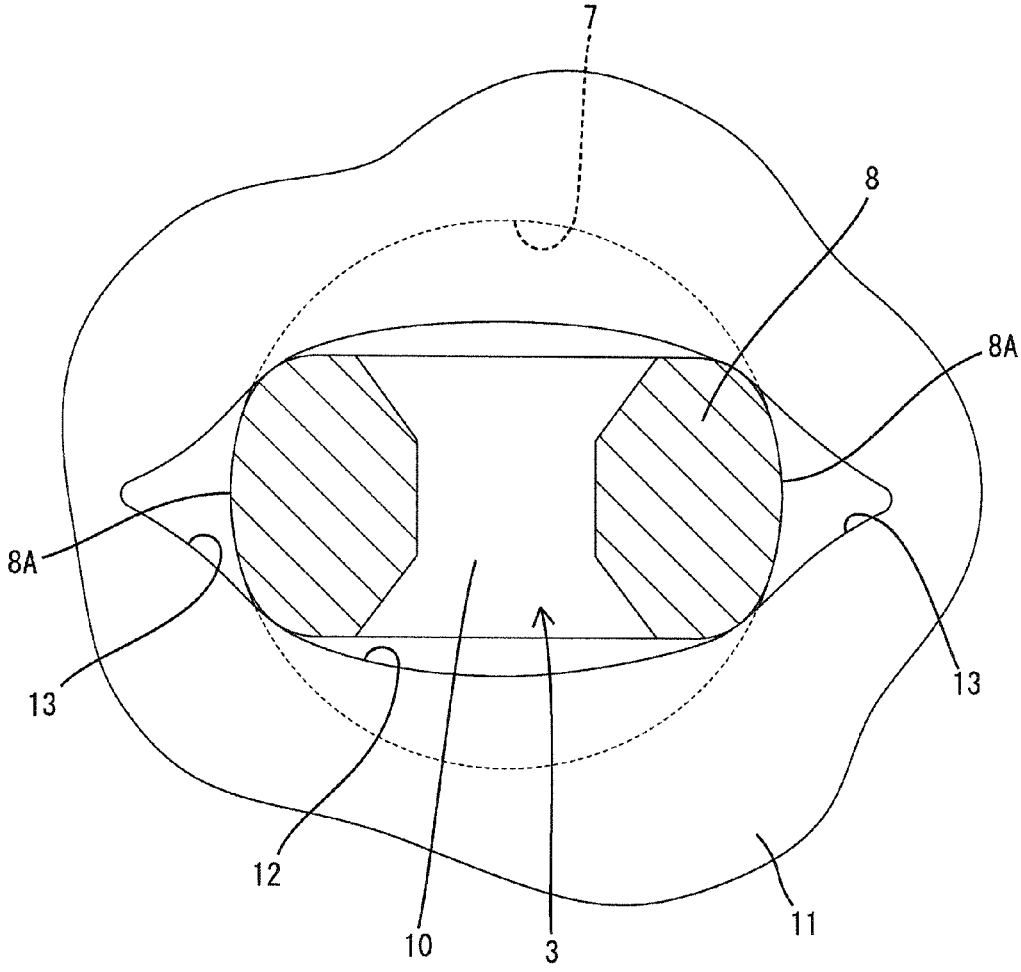
FIG. 8 is a plan sectional view corresponding to FIG. 5.

Each substrate connection part 4 has a press-fit portion 8 connected to the through-hole 7 and a guide 9 formed at the front end of the substrate connection part 4. The width of the press-fit portion 8 is largest at its central portion in its longitudinal direction, and its width becomes gradually smaller from its central portion toward both ends thereof in its longitudinal direction. A window 10 penetrates through the central portion of the press-fit portion 8. Similar to the press-fit portion 8, the width of the window hole 10 is largest at its central portion in its longitudinal direction, and its width becomes gradually smaller from its central portion toward both ends in its longitudinal direction. As shown in FIG. 4, the maximum width W1 at the center of the press-fit portion 8 in its longitudinal direction is slightly larger than a diameter W2 of the through-hole 7. Thus, when the press-fit portion 8 is positioned inside the through-hole 7, the press-fit portion 8 elastically deforms in and is capable of contacting the wall of the through-hole 7 at a predetermined contact pressure. As shown in FIG. 8, the sectional configuration of the press-fit portion 8 in the direction orthogonal to the axial direction is approximately oblong. Each side edge 8A of the press-fit portion 8 at the major axis side is formed in the shape of an arc surface.

Figure 7:
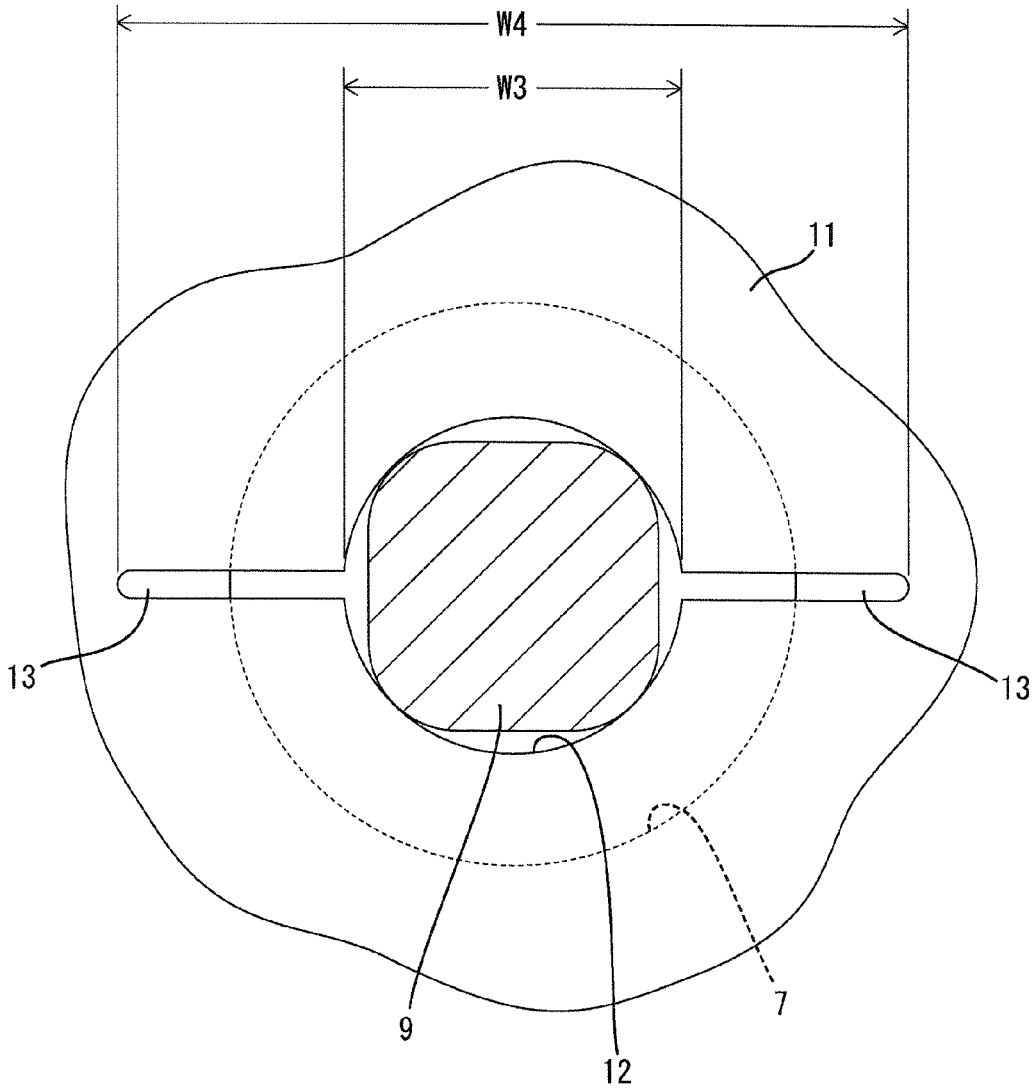
FIG. 7 is a plan sectional view corresponding to FIG. 4.

The width of the guide 9 is much smaller than the diameter of the through-hole 7. As shown in FIG. 7, the sectional configuration of the guide 9 in the direction orthogonal to the axial direction is approximately square, but the four corners thereof are arcuate.

Terminal arrangement members 11 are formed separately from the housings 1 and function to position the substrate connection part 4 of each of the press-fit terminals 3 pulled out of the housings 1. Each terminal arrangement member 11 is approximately rectangular and is made of a resin sheet (for example, PET having a thickness of about 0.1 mm) having an appropriate strength. Positioning holes 12 penetrate through the terminal arrangement member 11 in correspondence to the arrangement of the substrate connection parts 4 of the press-fit terminals 3. Thus, the positioning holes 12 are disposed at regular intervals in three rows in a short-side direction of the terminal arrangement member 11 and a plural number in the long-side direction thereof. The positioning holes 12 are substantially circular and coaxial with the respective through-holes 7 of the substrate 6.

As shown in FIG. 7, the diameter of each positioning hole 12 in its natural state is smaller than the dimension of a diagonal line of the guide 9 of the press-fit terminal 3. In a state in which the guide 9 of each press-fit terminal 3 is inserted into the positioning hole 12, each corner of the guide 9 is caught by an opening edge of the positioning hole 12. In the state in which the guide 9 of each press-fit terminal 3 is inserted into the positioning hole 12, each press-fit terminal 3 is placed in position, and the corners of the guide 9 are caught by the opening edge of the positioning hole 12. Thus, the terminal arrangement member 11 is held by the press-fit terminals 3 without being dropped therefrom.

In a natural state, the diameter W3 of the positioning hole 12 is smaller than the maximum width W1 (W1>W3) of the press-fit portion 8. In the drawings, the dimension of the press-fit portion 8 in its thickness direction is set slightly smaller than the diameter of the positioning hole 12, but this thickness may be larger than the diameter of the positioning hole 12.

A gap-forming part for expanding the positioning hole 12 is formed at the opening edge of each positioning hole 12. The gap-forming part of this first embodiment is defined by a pair of slits 13. The slits 13 extend diametrically out from positions of the opening edge of the positioning hole 12 that are opposed to the side edges 8A of the press-fit portion 8 of each press-fit terminal 3. The slits 13 penetrate through the terminal arrangement member 11 in the thickness direction thereof. In a natural state, both slits 13 define a certain width and a distance W4 between the closed longitudinal ends of the slits 13 of each positioning hole 12 exceeds the maximum width dimension W1 of the press-fit portion 8 before the press-fit terminals 3 are inserted into the terminal arrangement member 11. Thus, the positioning hole 12 is expandable in a plane direction in the process of passing the press-fit portion 8 through the positioning hole 12, thereby allowing the press-fit portion 8 to pass easily therethrough.

The substrate connection parts 4 of the press-fit terminals 3 are placed in position before the connector C is mounted on the substrate 6. More particularly, the substrate connection part 4 of each press-fit terminal 3 is fit in the corresponding positioning hole 12 and lightly pressed therein to insert the guide 9 into the positioning hole 12 (see FIGS. 4 and 7). The alignment of the press-fit terminals 3 is adjusted in this process of inserting the guides 9 into the respective positioning holes 12. The corners of the guide 9 contact the positioning hole 12 and are caught on the opening edge of the positioning hole 12, as shown in FIG. 7, with the corners slightly cutting therein. Thus, the terminal arrangement member 11 is held in a state in which the terminal arrangement member 11 does not fall off the press-fit terminals 3.

Figure 9:
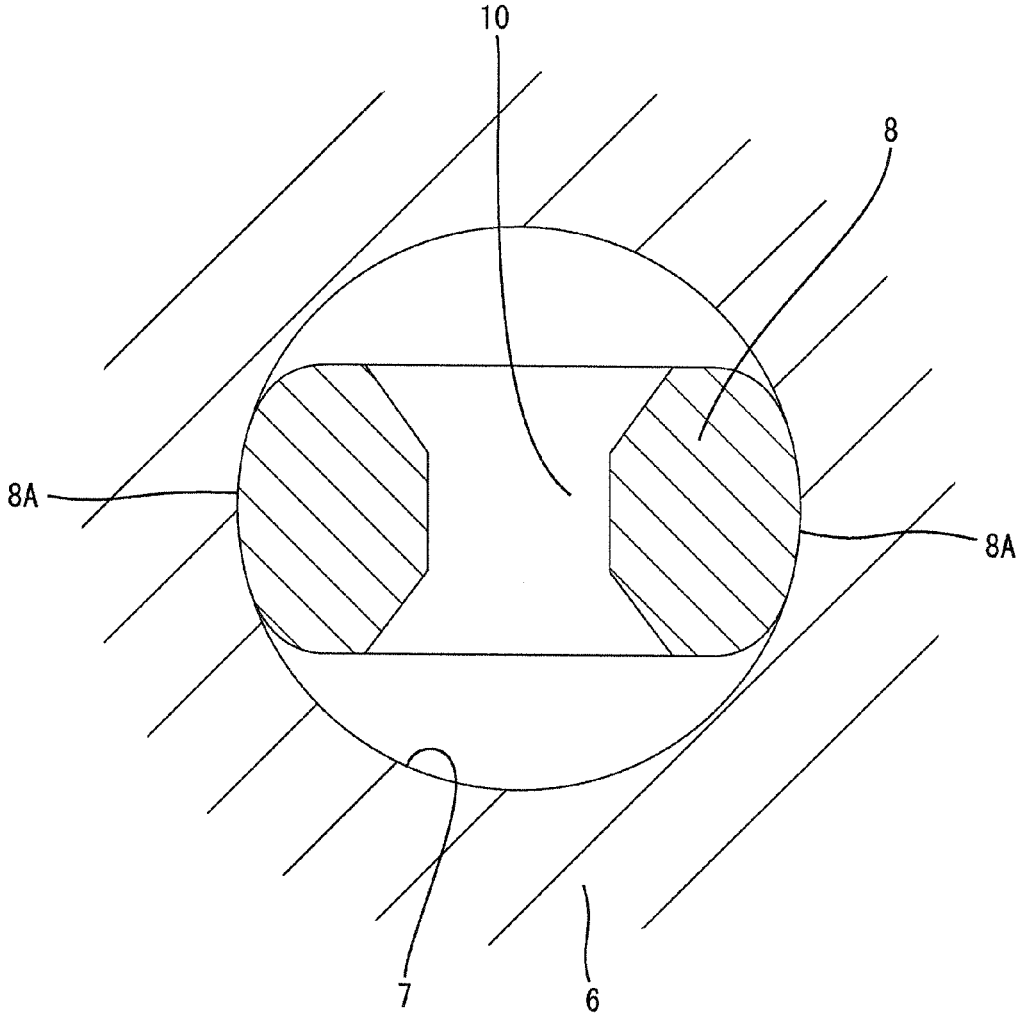
FIG. 9 is a plan sectional view showing a state in which a press-fit portion of the press-fit terminal has been normally inserted into the through-hole.

The connector C then is positioned above the substrate 6 with the terminal arrangement member 11 holding the press-fit terminals 3 in proper positions. Thus, the front ends of the guides 9 of the press-fit terminals 3 and the axes of the press-fit terminals 3 are aligned with the corresponding through-holes 7. The substrate connection parts 4 then are pressed into the respective through-holes 7 until the terminal arrangement member 11 closely contacts the substrate 6. The substrate connection parts 4 are inserted gradually into the corresponding through-holes 7 as the pressing operation proceeds. At this time, the press-fit portions 8 move inside the respective positioning holes 12. Movement of the press-fit portions 8 through the respective positioning holes 12 gradually widens the positioning holes 12 and expands the width of each slit 13 from the open end to the closed end thereof. Thus, the entire positioning holes 12 expand and deform so that the press-fit portions 8 can pass smoothly through the respective positioning holes 12. The maximum width area of the side edges 8A of the press-fit portion 8 contact the through-hole 7 at a predetermined contact pressure (see FIG. 9) when the press-fit portions 8 are inserted into the respective through-holes 7 to a predetermined normal depth. As a result, the press-fit terminals 3 are connected electrically to the respective through-holes 7.

The positioning hole 12 of this embodiment easily expands and deforms as the press-fit portion 8 passes through the positioning hole 12, due to the action of the slits 13 cut through the terminal arrangement member 11 from the positioning hole 12. Thus, the press-fit portion 8 is subjected to a low resistance and can pass smoothly through the positioning hole 12 without being deformed. Both side edges 8A of the press-fit portion 8 pass through the positioning hole 12 with the side edges 8A expanding the slits 13 in the slit width direction. Thus, the side edges 8A of the press-fit portion 8 will not force resin near the positioning hole into the through-hole 7 and no part of the terminal arrangement member 11 will be interposed between the side edges 8A of the press-fit portion 8 and the surface wall of the through-hole 7. As a result, the press-fit terminals 3 achieve proper electrical connection to the through-holes 7.

Figure 10:
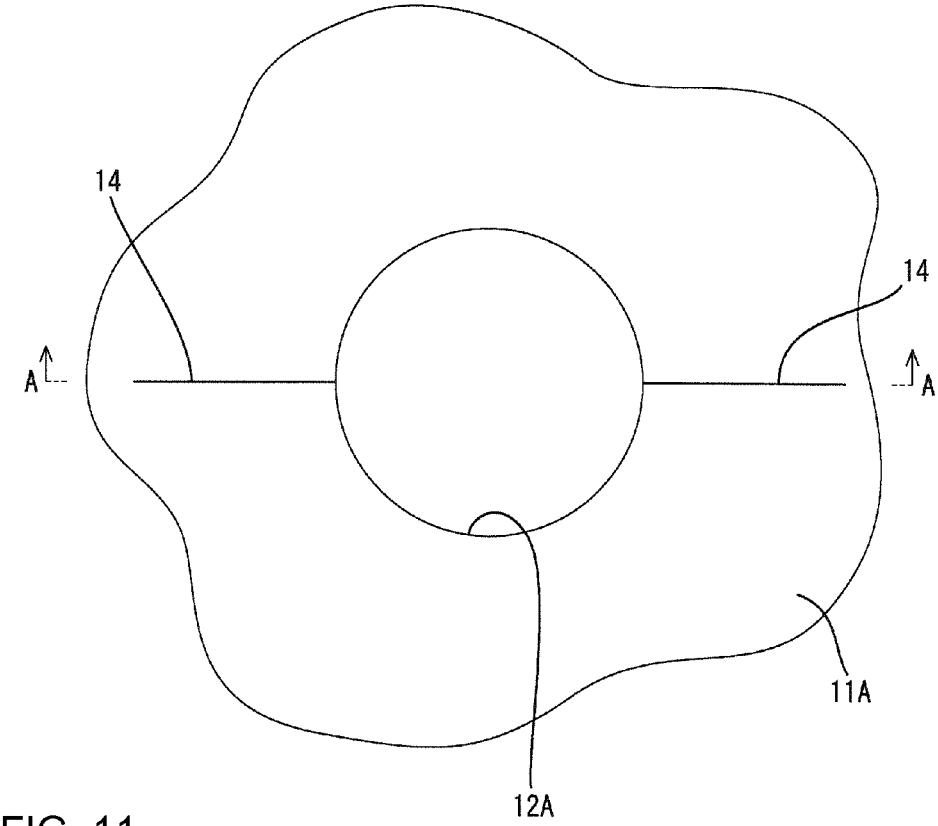
FIG. 10 is a plan view showing a positioning hole of an embodiment 2.
Figure 11:
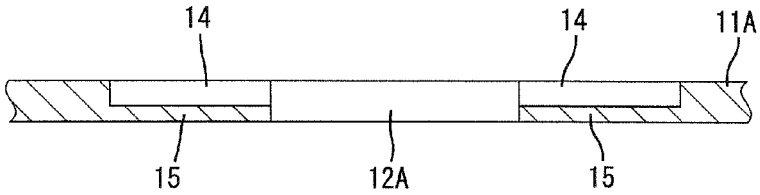
FIG. 11 is a sectional view taken along a line A-A of FIG. 10.

FIGS. 10 and 11 show a second embodiment of the invention. The gap-forming part of the first embodiment is formed by the slits 13 penetrating through the terminal arrangement member 11 in the thickness direction. A gap-forming part of the second embodiment is defined by a groove 14 formed on a surface of the terminal arrangement member 11A opposed to the insertion direction of the press-fit terminal 3. The groove 14 does not penetrate completely through the terminal arrangement member 11A in its thickness direction.

More particularly, two grooves 14 are formed at positions on the opening edge of a positioning hole 12A opposed to both side edges 8A of the press-fit portion 8 of the press-fit terminal 3 and the grooves 14 extend diametrically out from the opening edge of the positioning hole 12A. As shown in FIG. 11, both grooves 14 are formed on the surface of the terminal arrangement member 11A opposed to the substrate 6 by leaving a slight thickness thereon. The strength of a formed thin portion of the terminal arrangement member 11A is set so that the thin portion is fractured easily with the passage of both side edges 8A of the press-fit portion 8 through the positioning hole 12A.

The diameter of the positioning hole 12A and the length dimension of both cut grooves 14 are set equally to those of the slit 13 of the first embodiment. Other constructions of the second embodiment are similar to those of the first embodiment.

The opening edge of the positioning hole 12A of the second embodiment is continuous over the entire circumference. Thus, the positioning hole 12A does not expand inadvertently while positioning the press-fit terminal 3, and the positioning function the positioning hole 12A is assured. Other actions and effects of the second embodiment are similar to those of the first embodiment.

Figure 12:
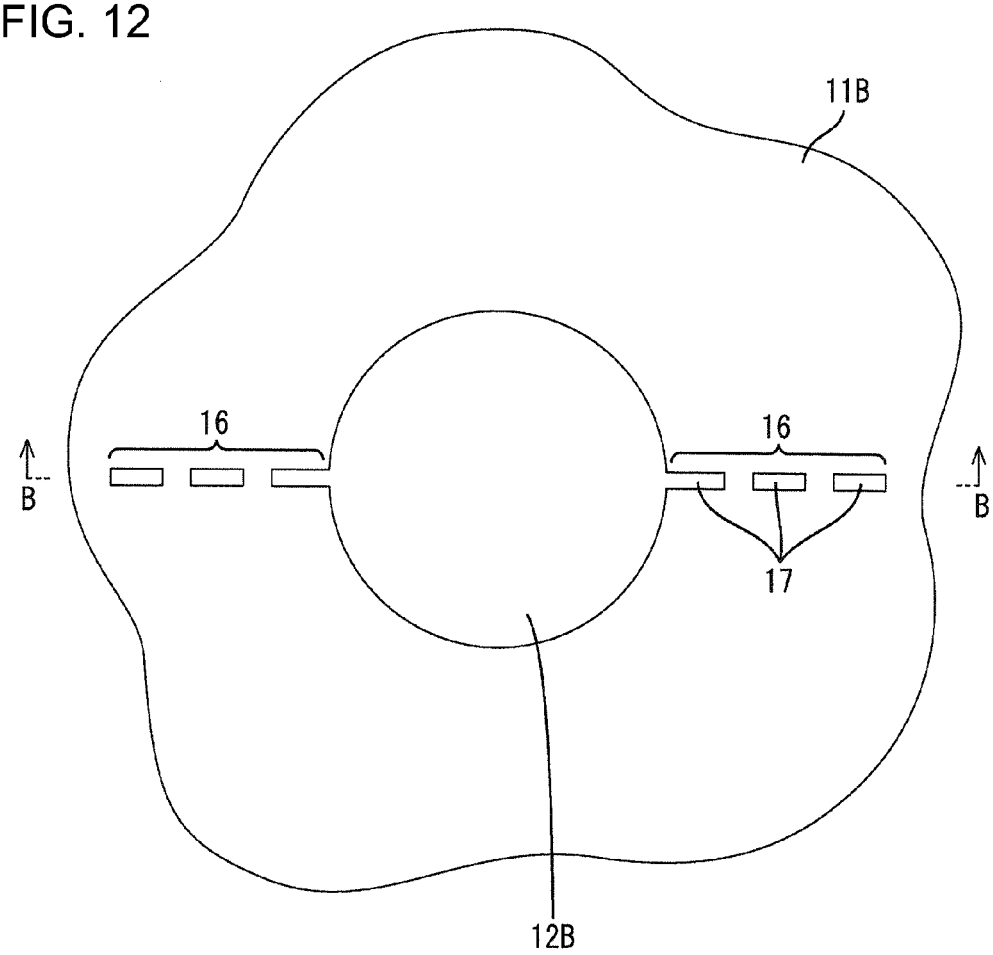
FIG. 12 is a plan view showing a positioning hole of an embodiment 3.
Figure 13:
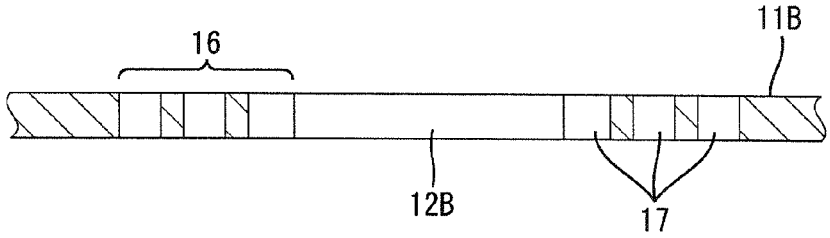
FIG. 13 is a sectional view taken along a line B-B of FIG. 12.

FIGS. 12 and 13 show a third embodiment of a terminal arrangement member 11B. The gap-forming part of the third embodiment 3 is defined by perforations 16. More specifically, two perforations 16 are formed by arranging through-holes 17 at regular intervals in diametrically outward directions from positions of the opening edge of the positioning hole 12B that are opposed to both side edges 8A of the press-fit portion 8 of each press-fit terminal 3.

The portion between adjacent through-holes 16 fracture easily as the press-fit portion 8 passes through the positioning hole 12B. The communication between the through-holes 16 creates a slit similar to that of the first embodiment at the opening edge of the positioning hole 12B. Thus the slit contributes to an easy expansion of the positioning hole 12.

Other constructions, actions and effects of the third embodiment are similar to those of the first and second embodiments.

The invention is not limited to the embodiments described above with reference to the drawings. For example, the following embodiments also are included in the scope of invention.

The positioning hole 12 and the guide 9 of the press-fit terminal 3 have the dimensional relationship that only the four corners of the guide 9 overlap the opening edge of the positioning hole 12. However, the positioning hole 12 and the guide 9 of the press-fit terminal 3 may have a dimensional relationship that the entire circumference of the guide 9 overlaps the opening edge of the positioning hole 12.

The press-fit portion 8 of the press-fit terminal 3 has the window 10 penetrating through the press-fit portion 8. However, the press-fit portion 8 need not have the window hole 10, provided that the press-fit portion 8 is elastically deformable so that the press-fit portion 8 contacts the through-hole 7 at a predetermined contact pressure.

What is claimed is:

1. A connector for mounting on a substrate that has through-holes formed therethrough, the connector comprising:

a housing mountable on the substrate;

press-fit terminals mounted in the housing, each press-fit terminal having a bulging press-fit portion projecting from the housing and disposed to be press-fit into one of the through-holes, the bulging press-fit portion defining a maximum bulging width (W1); and a terminal arrangement sheet having positioning holes extending entirely through the terminal arrangement sheet in a thickness direction, the positioning holes being disposed and dimensioned for receiving portions of the respective press-fit terminals forward from the press-fit portion of the respective press-fit terminal and positioning the press-fit terminals prior to insertion into the respective through-holes, the positioning holes having diameters (W3) less than the maximum bulging width (W1) of the bulging press-fit portion, gap-forming slits extending entirely through the terminal arrangement sheet in the thickness direction and projecting out from opening edge areas of each of said positioning holes at locations to align with side edges of said press-fit portions corresponding to a maximum width of the respective press-fit portion, a total extending dimension (W4) of the slits across the respective positioning hole exceeding the maximum bulging width (W1) of the bulging press-fit portion, wherein the slits enable expansion of each of said positioning holes as the corresponding press-fit portion passes through the positioning hole.

2. The connector of claim 1, wherein the terminal arrangement sheet is made of a resin material.

3. The connector of claim 2, wherein the resin material of the terminal arrangement sheet is about 0.1 mm thick.

4. A connector for mounting on a substrate that has through-holes formed therethrough, the connector comprising:

a housing mountable on the substrate;

press-fit terminals mounted in the housing, each press-fit terminal having a bulging press-fit portion projecting from the housing and disposed to be press-fit into one of the through-holes; and a terminal arrangement member having positioning holes disposed and dimensioned for receiving portions of the respective press-fit terminals forward from the press-fit portion of the respective press-fit terminal and positioning the press-fit terminals prior to insertion into the respective through-holes, gap-forming grooves extending out from opening edge areas of each of said positioning holes and being disposed to align with side edges of the press-fit portions corresponding to a maximum width of the respective press-fit portion, the grooves extending partly through a thickness of the terminal arrangement member and being configured to enable expansion of each of said positioning holes as the corresponding press-fit portion passes through the positioning hole, wherein the grooves have depths dimensioned so that remaining portions of the terminal arrangement member are retained adjacent the grooves, the remaining portions being dimensioned to fracture as the press-fit portion is pressed through the positioning hole.

5. A connector for mounting on a substrate that has through-holes formed therethrough, the connector comprising:

a housing mountable on the substrate;

press-fit terminals mounted in the housing, each press-fit terminal having a bulging press-fit portion projecting from the housing and disposed to be press-fit into one of the through-holes; and a terminal arrangement member having positioning holes disposed and dimensioned for receiving portions of the respective press-fit terminals forward from the press-fit portion of the respective press-fit terminal and positioning the press-fit terminals prior to insertion into the respective through-holes, gap-forming perforations formed by arrays of substantially side by side perforation-holes extending radially out at predetermined intervals from positions at the opening edge area of the positioning hole that are opposed to the side edges of the press-fit portion corresponding to a maximum width of the respective press-fit portion, the gap-forming perforations being configured to enable expansion of each of said positioning holes as the corresponding press-fit portion passes through the positioning hole.

6. The connector of claim 5, wherein portions of the terminal arrangement member between the perforation holes are dimensioned to fracture as the press-fit portion is pressed through the positioning hole.

7. The connector of claim 5, wherein the terminal arrangement member is made of a resin sheet material.

8. The connector of claim 7, wherein the resin sheet material of the terminal arrangement member is about 0.1 mm thick.

9. The connector of claim 4, wherein the terminal arrangement member is made of a resin sheet material.

10. The connector of claim 9, wherein the resin sheet material of the terminal arrangement member is about 0.1 mm thick.

* * * * *